US006609262B2

(12) United States Patent
Cheng

(10) Patent No.: US 6,609,262 B2
(45) **Date of Patent: *Aug. 26, 2003**

(54) MAGNETIC TOOL STRUCTURE

(76) Inventor: Chin Shun Cheng, No. 1, Alley 16, Lane 40, Jinn Te Road, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/947,600

(22) Filed: Sep. 7, 2001

(65) Prior Publication Data

US 2003/0046768 A1 Mar. 13, 2003

(51) Int. Cl.[7] ..... B25B 13/00
(52) U.S. Cl. ..... 7/138; 81/125; 7/165
(58) Field of Search ..... 7/138, 165, 960; 81/125

(56) References Cited

U.S. PATENT DOCUMENTS 3,126,774 A * 3/1964 Carr et al. ..... 81/125
3,145,595 A * 8/1964 Mauck ..... 81/125
3,207,010 A * 9/1965 Wendling ..... 81/125
6,105,190 A * 8/2000 Shiao ..... 7/165
6,405,396 B1 * 6/2002 Tsai ..... 7/165

* cited by examiner

*Primary Examiner*—James G. Smith

(57) ABSTRACT

A magnetic tool structure includes a body having a square end formed with a receiving seat, and a magnetic device mounted on the receiving seat of the body. The magnetic device includes an outer retractable rod secured and hidden in the receiving seat, an inner retractable rod retractably mounted on the outer retractable rod, and a magnetic body secured on the inner retractable rod to move therewith. In use, the magnetic body can be extended outward from the receiving seat of the body and fully inserted into the receiving seat of the body, so that when the magnetic device is retracted and shortened to a minimum length thereof, the magnetic device is fully hidden in the receiving seat of the body.

2 Claims, 10 Drawing Sheets

MAGNETIC TOOL STRUCTURE

BACKGROUND OF THE INVENTION

1. Field of the Invention

The present invention relates to a magnetic tool structure, and more particularly to a magnetic tool structure that can be expanded conveniently.

2. Description of the Related Art

A conventional socket wrench in accordance with the prior art shown in FIG. 1 comprises a wrench body 10 that may co-operate with a socket 22 to operate and rotate a workpiece 32 such as a nut or the like. However, the workpiece 32 is easily detached from the socket 22 during rotation, thereby greatly causing inconvenience to the user in employing the wrench body 10 of the socket wrench to operate and rotate the workpiece 32. In addition, when the workpiece 32 is unscrewed from a screw hole (not shown), the workpiece 32 is easily detached from the socket 22 to fall down, thereby greatly causing inconvenience to the user during operation. Further, the user has to operate the wrench body 10 of the socket wrench to rot ate the workpiece 32 by his one hand, with his hand holding the workpiece 32, thereby greatly causing inconvenience to the user during operation of the wrench body 10 of the socket wrench.

SUMMARY OF THE INVENTION

The present invention has arisen to mitigate and/or obviate the disadvantage of the conventional socket wrench.

The primary objective of the present invention is to provide a magnetic tool structure that can be expanded easily and conveniently, thereby enhancing convenience of utilization of the tool structure.

In accordance with the present invention, there is provided a magnetic tool structure, comprising:

a body having a square end formed with a receiving seat; and a magnetic device mounted on the receiving seat of the square end of the body, the magnetic device including an outer retractable rod secured and hidden in the receiving seat of the square end of the body, an inner retractable rod retractably mounted on the outer retractable rod, and a magnetic body secured on the inner retractable rod to move therewith;

wherein, the magnetic body can be extended outward from the receiving seat of the square end of the body and fully inserted into the receiving seat of the square end of the body, so that when the magnetic device is retracted and shortened to a minimum length thereof, the magnetic device is filly hidden in the receiving seat of the square end of the body.

Further benefits and advantages of the present invention will become apparent after a careful reading of the detailed description with appropriate reference to the accompanying drawings.

DETAILED DESCRIPTION OF THE INVENTION

Figure 1:
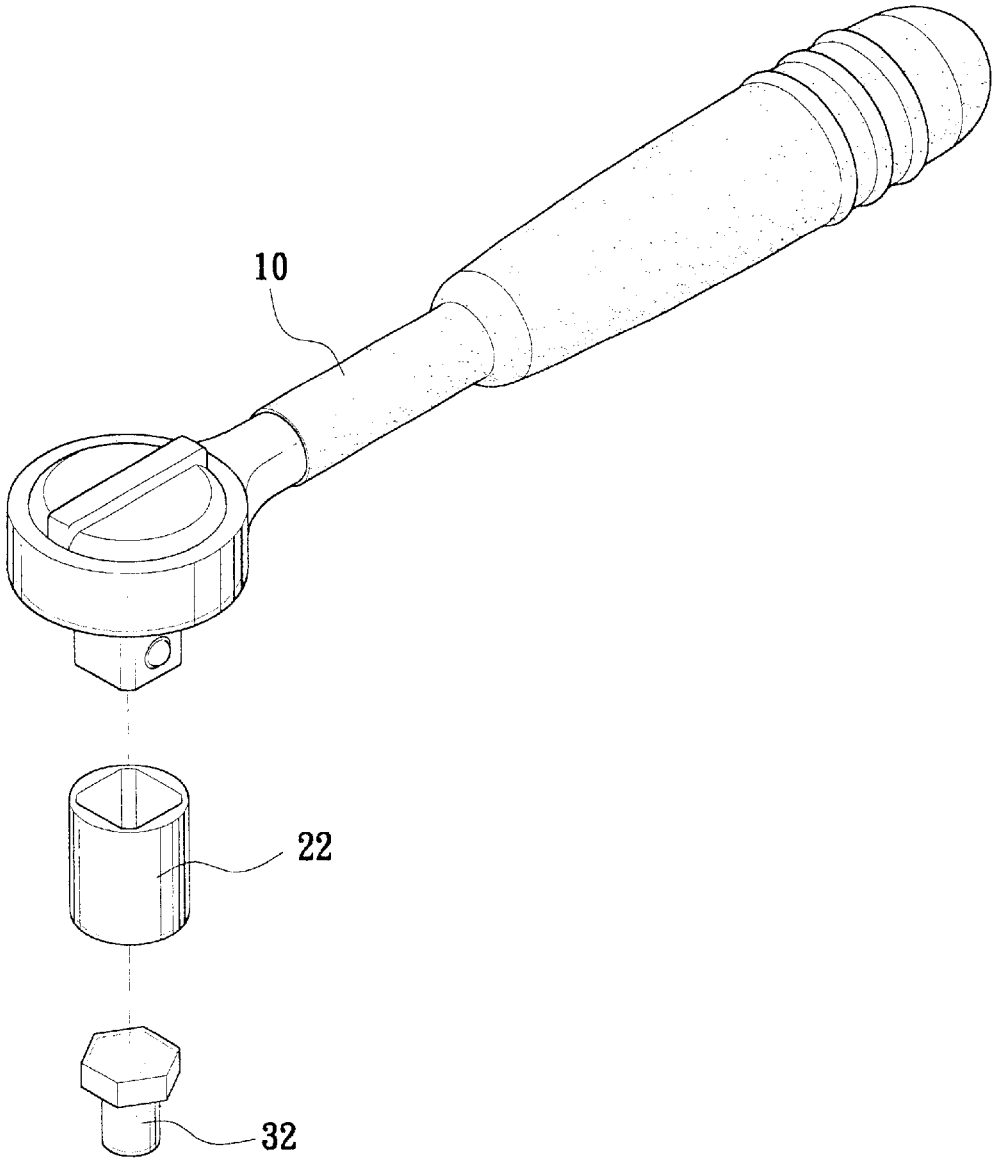
F I G. 1 PRIOR ART
FIG. 1 is a perspective view of a conventional socket wrench in accordance with the prior art.
Figure 2:
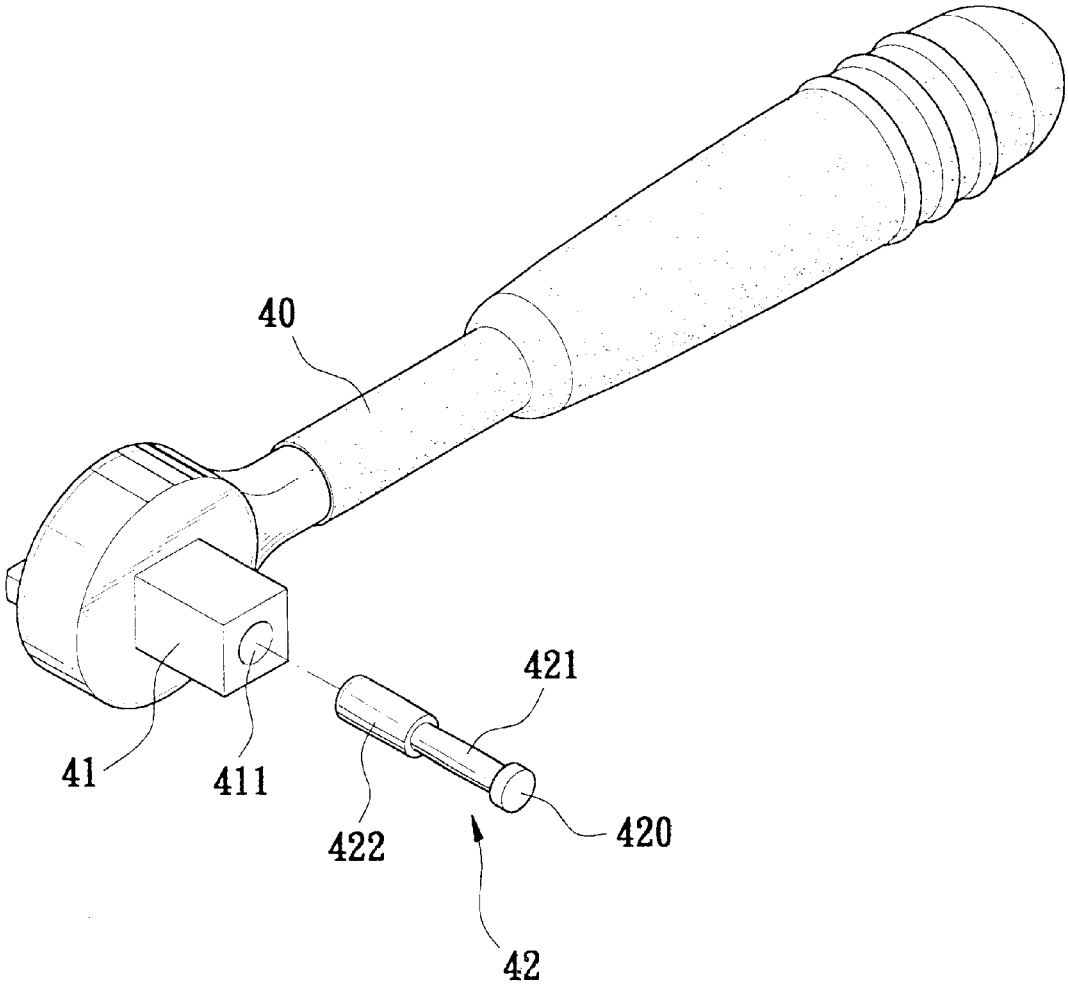
FIG. 2 is an exploded perspective view of a magnetic tool structure in accordance with a first embodiment of the present invention.

Referring to the drawings and initially to FIGS. 2–5, a magnetic tool structure in accordance with a first embodiment of the present invention is available for a socket wrench or the like and comprises a wrench body 40 having a square end 41 formed with a receiving seat 411, and a magnetic device 42 mounted on the receiving seat 411. The magnetic device 42 includes an outer retractable rod 422 secured and hidden in the receiving seat 411, an inner retractable rod 421 retractably mounted on the outer retractable rod 422, and a magnetic body 420 secured on the inner retractable rod 421 to move therewith.

The outer retractable rod 422 is fully hidden in the receiving seat 411. The inner retractable rod 421 may be retracted into the outer retractable rod 422, and the magnetic body 420 may move with the inner retractable rod 421 to be fully inserted into the receiving seat 411. Thus, when the magnetic device 42 is retracted and shortened to the minimum length, the magnetic device 42 may be fully hidden in the receiving seat 411 as shown in FIG. 3.

Figure 3:
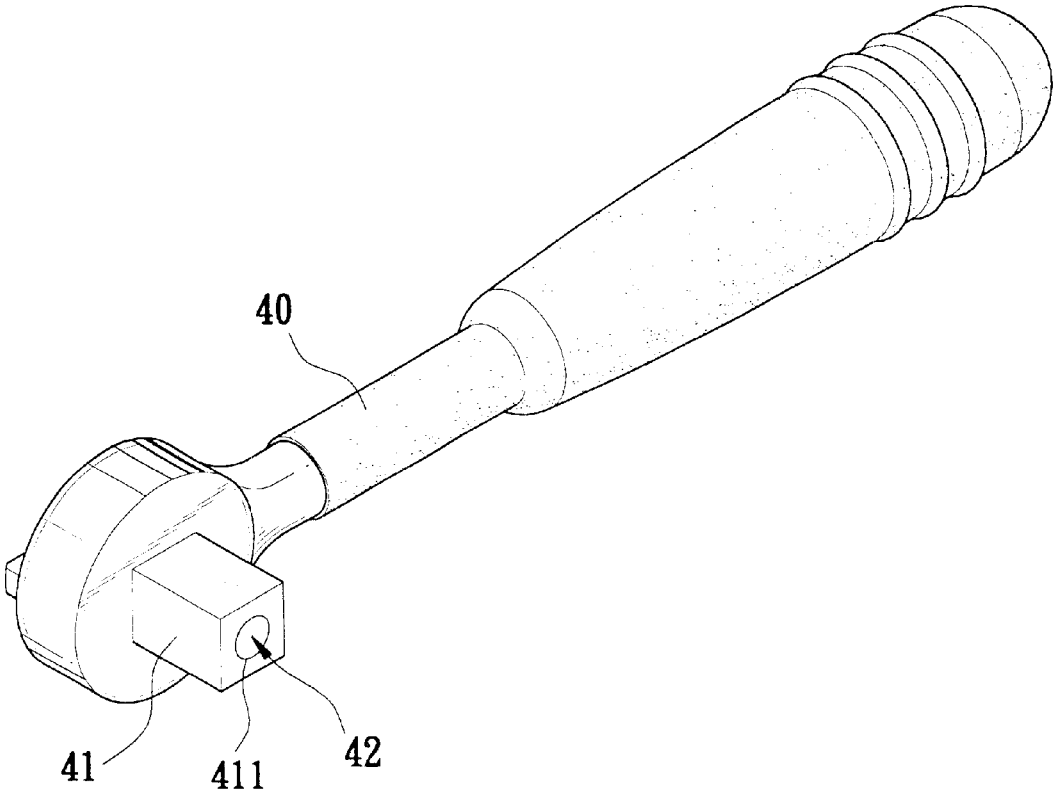
FIG. 3 is a perspective assembly view of the magnetic tool structure as shown in FIG. 2.
Figure 4:
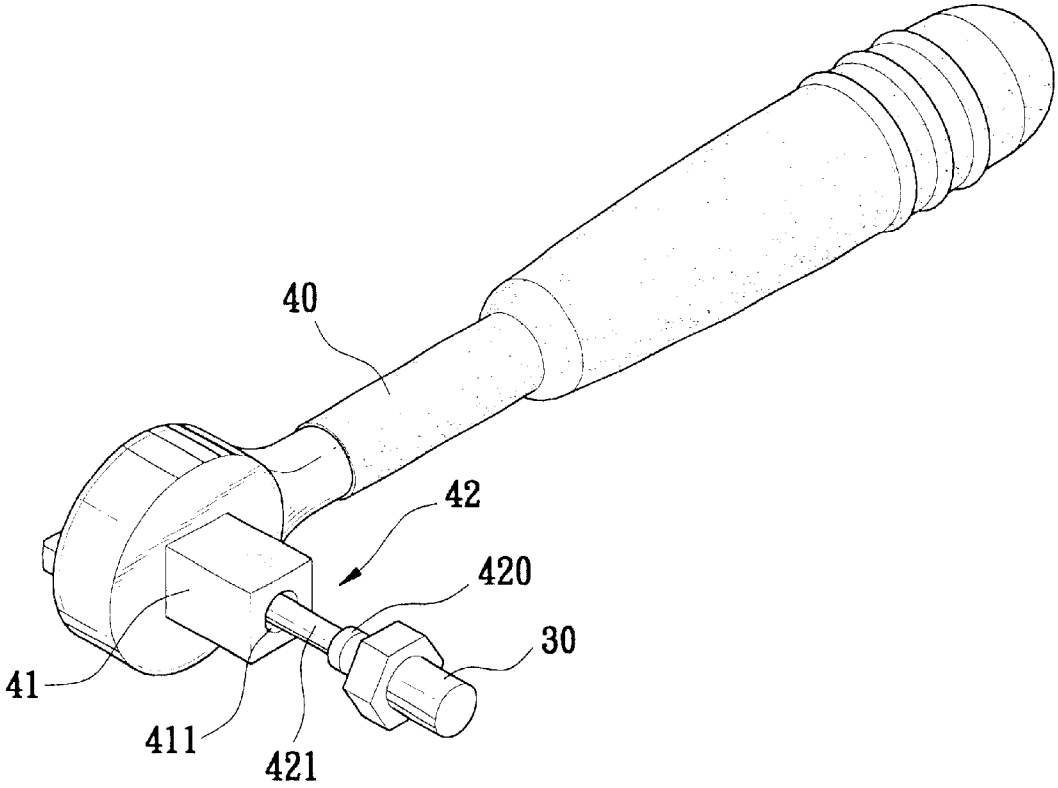
FIG. 4 is a schematic operational view of the magnetic tool structure as shown in FIG. 3 in use.

In use, the magnetic body 420 of the magnetic device 42 is initially fully hidden in the receiving seat 411 of the wrench body 40 as shown in FIG. 3. The user may take a workpiece 30 such as a nut or the like to approach the receiving seat 411 of the wrench body 40, so that the magnetic body 420 of the magnetic device 42 may be pulled outward from the receiving seat 411 of the wrench body 40 as shown in FIG. 4.

Figure 5:
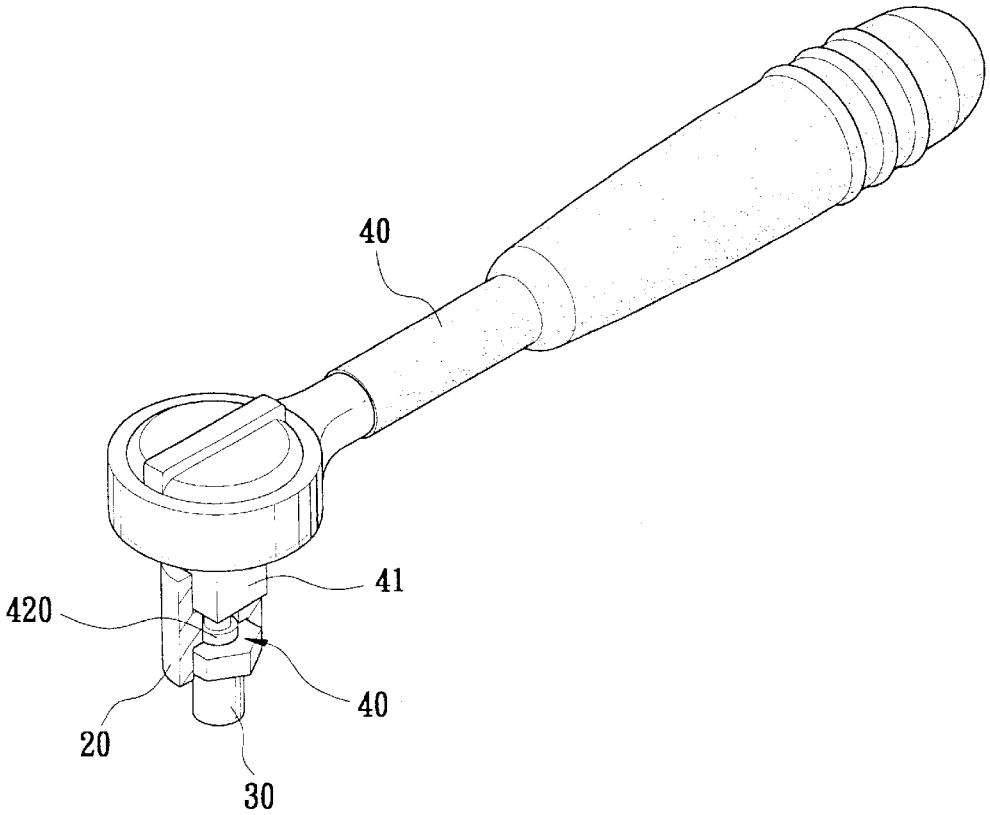
FIG. 5 is a schematic operational view of the magnetic tool structure as shown in FIG. 3 in use.

In operation, referring to FIG. 5, a socket 20 may be fitted on the square end 41 of the wrench body 40 at its one end, and may be fitted on the workpiece 30 at the other end thereof, so that the square end 41 of the wrench body 40 may co-operate with the socket 20 to operate and rotate the workpiece 30. The workpiece 30 is attracted by the magnetic body 420 of the magnetic device 42, so that the workpiece 30 will not detach from the socket 20 during rotation. When the workpiece 30 is unscrewed from a screw hole (not shown), the workpiece 30 is still attracted by the magnetic body 420 of the magnetic device 42, so that the workpiece 30 will not detach from the socket 20 to fall downward, thereby greatly facilitating the user employing the wrench body 40 of the socket wrench to operate and rotate the workpiece 30. In addition, the user can operate the wrench body 40 of the socket wrench to rotate the workpiece 30 by his one hand only, without having to hold the workpiece 30 with his other hand, thereby facilitating the user employing the wrench body 40 of the socket wrench.

Figure 6:
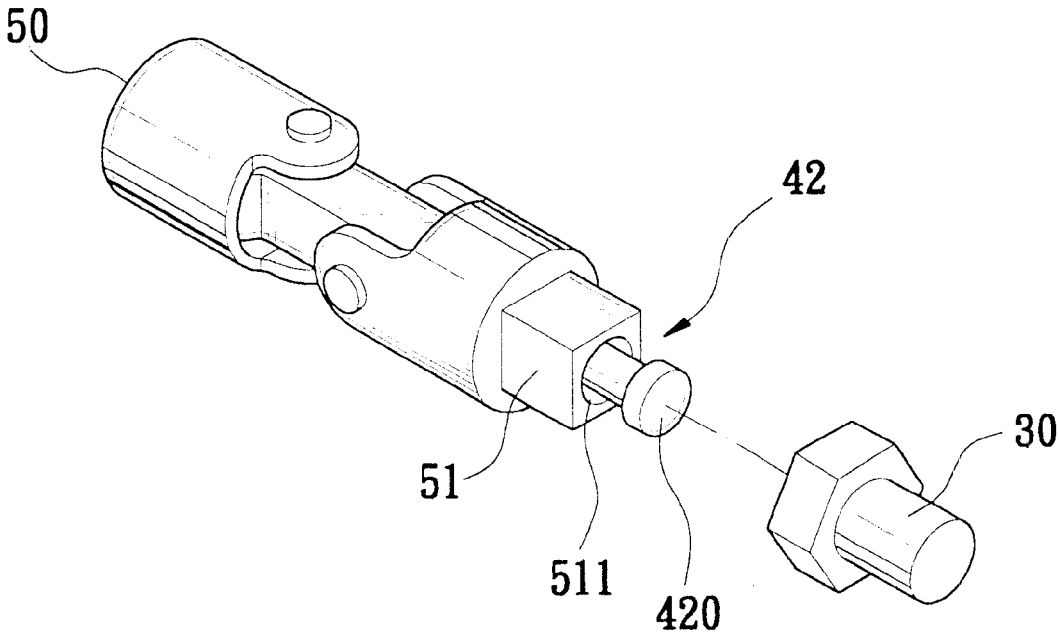
FIG. 6 is a perspective assembly view of a magnetic tool structure in accordance with a second embodiment of the present invention.

Referring to FIG. 6, a magnetic tool structure in accordance with a second embodiment of the present invention is available for a float connector or the like and comprises a connector body 50 having a square end 51 formed with a receiving seat 511. The magnetic device 42 may be mounted in the receiving seat 511. A socket (not shown) may be fitted on the square end 51 of the connector body 50 at its one end, and may be fitted on the workpiece 30 at the other end thereof, so that the square end 51 of the connector body 50 may co-operate with the socket to operate and rotate the workpiece 30. The workpiece 30 is attracted by the magnetic body 420 of the magnetic device 42, so that the workpiece 30 will not detach from the socket during rotation. When the workpiece 30 is unscrewed from a screw hole (not shown), the workpiece 30 is still attracted by the magnetic body 420 of the magnetic device 42, so that the workpiece 30 will not detach from the socket to fall downward, thereby greatly facilitating the user employing the connector body 50 of the float connector to operate and rotate the workpiece 30.

Figure 7:
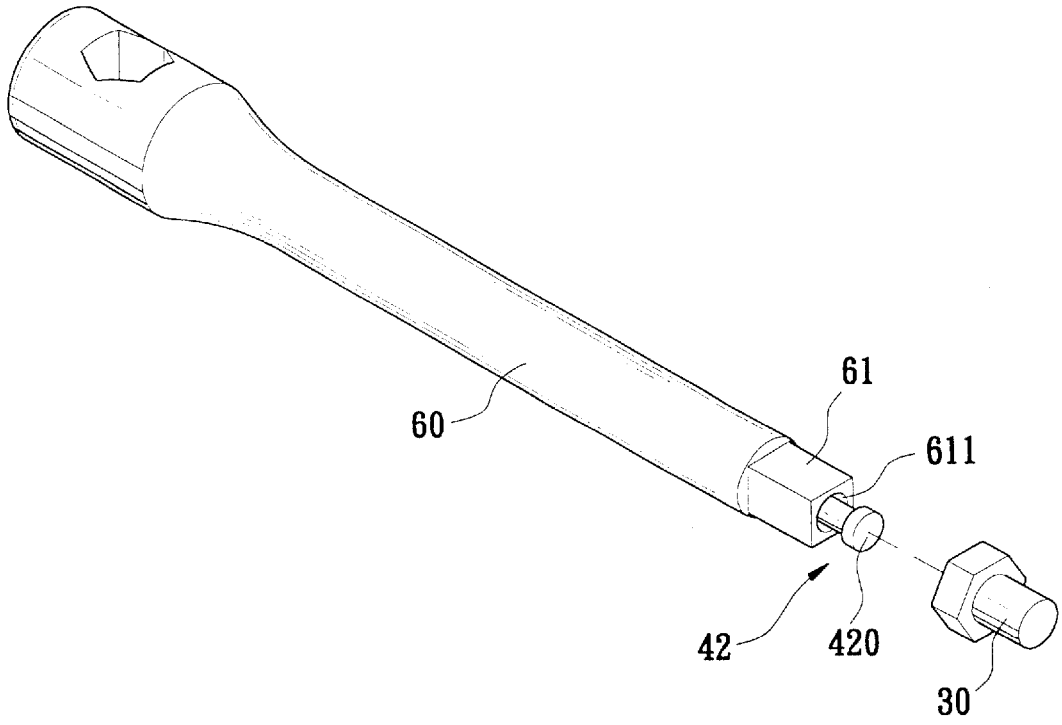
FIG. 7 is a perspective assembly view of a magnetic tool structure in accordance with a third embodiment of the present invention.

Referring to FIG. 7, a magnetic tool structure in accordance with a third embodiment of the present invention is available for a socket extension or the like and comprises an extension body 60 having a square end 61 formed with a receiving seat 611. The magnetic device 42 may be mounted in the receiving seat 611. A socket (not shown) may be fitted on the square end 61 of the extension body 60 at its one end, and may be fitted on the workpiece 30 at the other end thereof, so that the square end 61 of the extension body 60 may co-operate with the socket to operate and rotate the workpiece 30. The workpiece 30 is attracted by the magnetic body 420 of the magnetic device 42, so that the workpiece 30 will not detach from the socket during rotation. When the workpiece 30 is unscrewed from a screw hole (not shown), the workpiece 30 is still attracted by the magnetic body 420 of the magnetic device 42, so that the workpiece 30 will not detach from the socket to fall downward, thereby greatly facilitating the user employing the extension body 60 of the socket extension to operate and rotate the workpiece 30. If the workpiece 30 falls into a narrow space, the magnetic device 42 may be lengthened to extend the magnetic body 420 into the narrow space to attract the workpiece 30.

Figure 8:
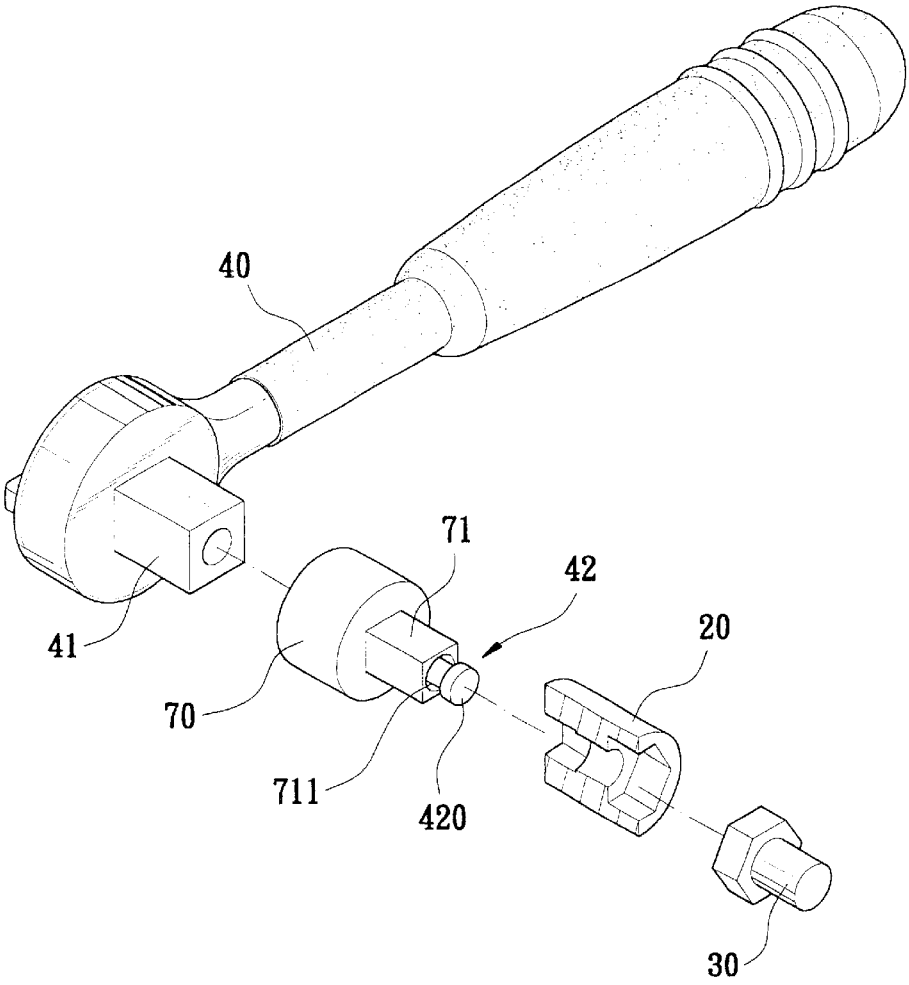
FIG. 8 is a perspective assembly view of a magnetic tool structure in accordance with a fourth embodiment of the present invention.

Referring to FIG. 8, a magnetic tool structure in accordance with a fourth embodiment of the present invention is available for a connector or the like and comprises a connector body 70 having a square end 71 formed with a receiving seat 711. The magnetic device 42 may be mounted in the receiving seat 711. A socket 20 may be fitted on the square end 71 of the wrench body 70 at its one end, and may be fitted on the workpiece 30 at the other end thereof, so that the square end 71 of the wrench body 70 may co-operate with the socket 20 to operate and rotate the workpiece 30. The workpiece 30 is attracted by the magnetic body 420 of the magnetic device 42, so that the workpiece 30 will not detach from the socket 20 during rotation. When the workpiece 30 is unscrewed from a screw hole (not shown), the workpiece 30 is still attracted by the magnetic body 420 of the magnetic device 42, so that the workpiece 30 will not detach from the socket 20 to fall down, thereby greatly facilitating the user employing the connector body 70 of the connector to operate and rotate the workpiece 30.

Figure 9:
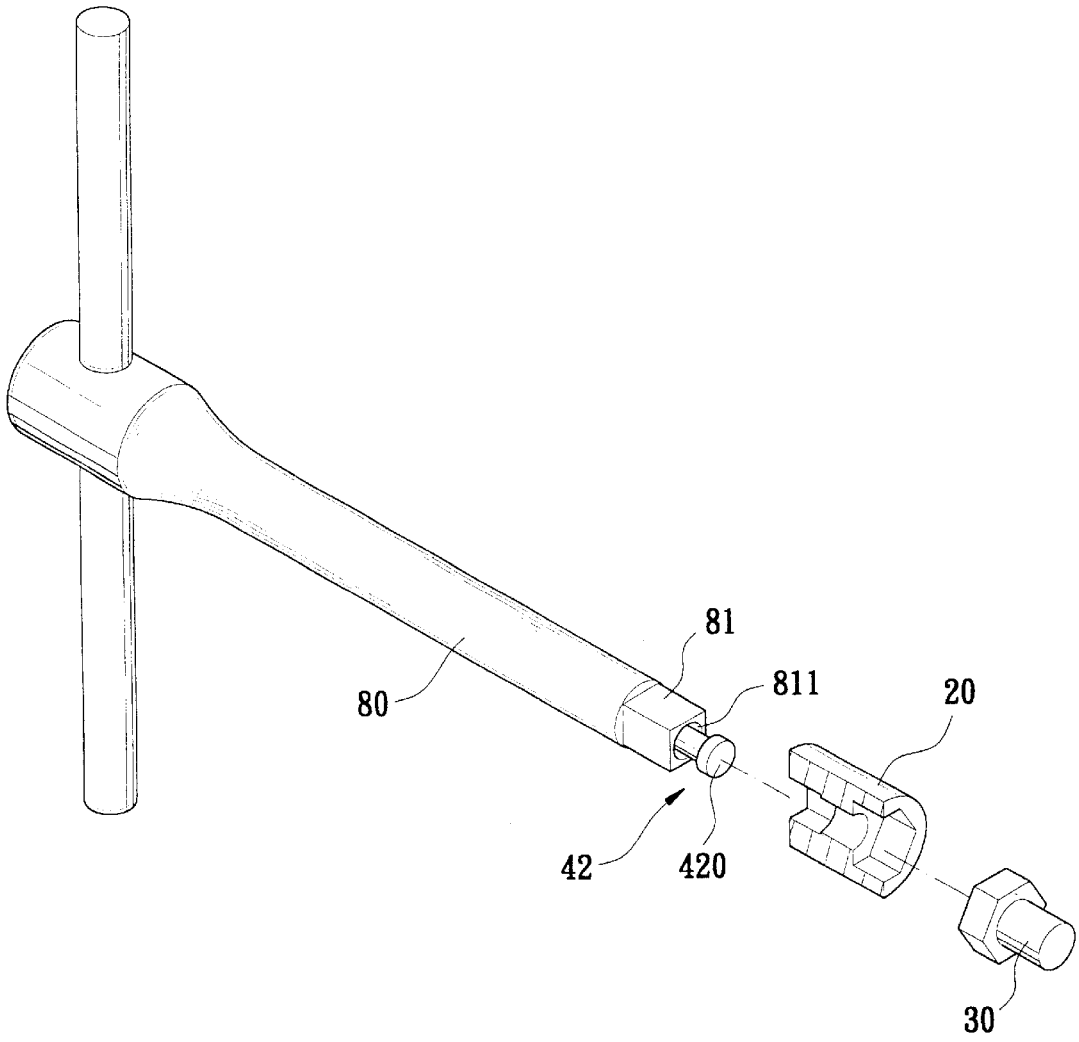
FIG. 9 is a perspective assembly view of a magnetic tool structure in accordance with a fifth embodiment of the present invention.

Referring to FIG. 9, a magnetic tool structure in accordance with a fifth embodiment of the present invention is available for a T-shaped socket extension or the like and comprises an extension body 80 having a square end 81 formed with a receiving seat 811. The magnetic device 42 may be mounted in the receiving seat 811. A socket 20 may be fitted on the square end 81 of the wrench body 80 at its one end, and may be fitted on the workpiece 30 at the other end thereof, so that the square end 81 of the wrench body 80 may co-operate with the socket 20 to operate and rotate the workpiece 30. The workpiece 30 is attracted by the magnetic body 420 of the magnetic device 42, so that the workpiece 30 will not detach from the socket 20 during rotation. When the workpiece 30 is unscrewed from a screw hole (not shown), the workpiece 30 is still attracted by the magnetic body 420 of the magnetic device 42, so that the workpiece 30 will not detach from the socket 20 to fall down, thereby greatly facilitating the user employing the extension body 80 of the socket extension to operate and rotate the workpiece 30.

Figure 10:
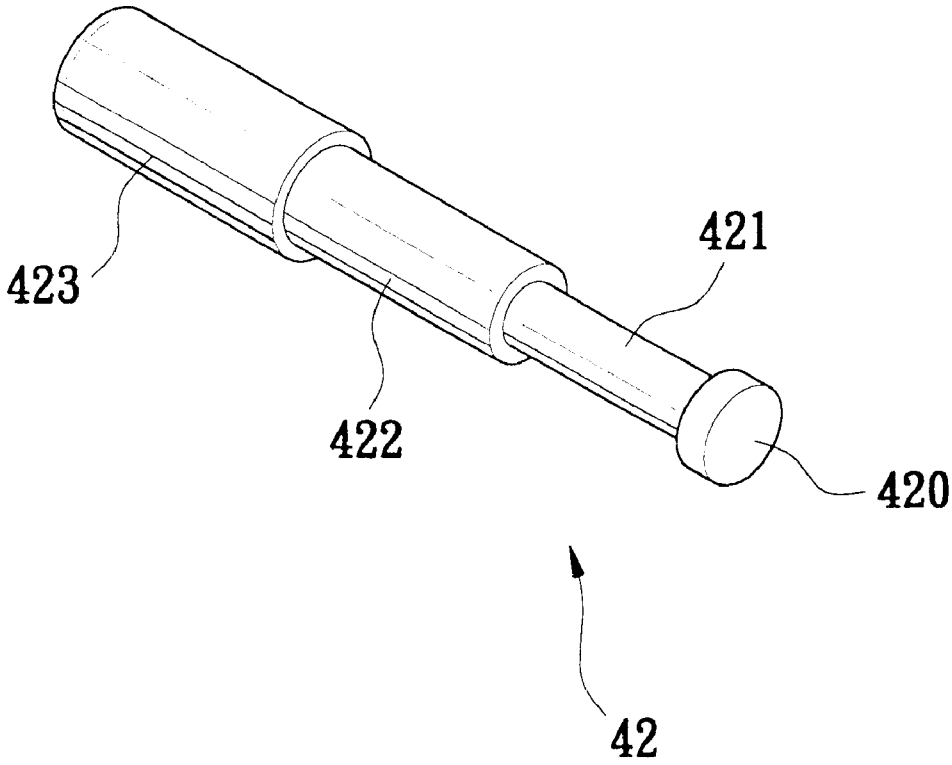
FIG. 10 is a perspective view of a magnetic device of a magnetic tool structure in accordance with another embodiment of the present invention.

Referring to FIG. 10, in accordance with another embodiment of the present invention, the magnetic device 42 further includes an outer tube 423 mounted the outer retractable rod 422, so that the magnetic device 42 may have a greater length.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A magnetic tool structure, comprising:

a body having a square end formed with a receiving seat; and a magnetic device mounted on and fully hidden in said receiving seat of said square end of said body, said magnetic device including an outer retractable rod secured and fully hidden in said receiving seat of said square end of said body, an inner retractable rod retractably mounted on said outer retractable rod, and a magnetic body secured on said inner retractable rod to move therewith;

wherein, said magnetic body can be extended outward from said receiving seat of said square end of said body and fully inserted into and hidden in said receiving seat of said square end of said body, so that when said magnetic device is retracted and shortened to a minimum length thereof, said magnetic device is fully hidden in said receiving seat of said square end of said body.

2. The magnetic tool structure in accordance with claim 1, wherein said magnetic device further includes an outer tube mounted on said outer retractable rod, so that said magnetic device has a greater length.

* * * * *